US006837945B1

(12) United States Patent
Sandberg et al.

(10) Patent No.: US 6,837,945 B1
(45) Date of Patent: Jan. 4, 2005

(54) STEEL COLD WORK TOOL, ITS USE AND MANUFACTURING

(75) Inventors: Odd Sandberg, Uddeholm (SE); Bo Rydell, Eskilstuna (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 0 days.

(21) Appl. No.: 09/959,455

(22) PCT Filed: Apr. 28, 2000

(86) PCT No.: PCT/SE00/00825

§ 371 (c)(1),
(2), (4) Date: Oct. 26, 2001

(87) PCT Pub. No.: WO00/66801

PCT Pub. Date: Nov. 9, 2000

(30) Foreign Application Priority Data

Apr. 30, 1999 (SE) ..... 9901554

(51) Int. Cl.[7] ..... C22C 38/18; C22C 38/24; C22C 38/26

(52) U.S. Cl. ..... 148/333; 148/321; 148/334; 148/328; 420/9; 420/100; 420/104; 420/105; 420/110; 420/111

(58) Field of Search ..... 148/328, 321, 148/333, 334; 420/9, 100, 104, 105, 110, 111

(56) References Cited

U.S. PATENT DOCUMENTS 5,106,576 A * 4/1992 Noda et al. ..... 419/8

5,738,734 A 4/1998 Sawa et al. ..... 148/324

FOREIGN PATENT DOCUMENTS

GB 1 587 843 6/1977 ..... C22C/38/14

OTHER PUBLICATIONS

Copy of International Search Report JP 57108248 A (Kanto Tokushu Seiko KK) Jul. 6, 1992 (Abstract) World Patents Index (Online). London, U.K.: Derwent Publications Ltd. (Retrieved on Aug. 8, 2000). Retrieved From: EPO WPI Database DW198232, Accession No. 192–67263.

JP57108248 (Kanto Tokushu Seikou KK) Oct. 6, 1982 (Abstract), (Online) Retrieved On Aug. 8, 2000 Retrieved rom: EPO PAJ Database.

* cited by examiner

*Primary Examiner*—Sikyin Ip
(74) *Attorney, Agent, or Firm*—Nixon & Vanderhye

(57) ABSTRACT

The invention concerns a steel article, which consists of an alloy having a chemical composition, which contains in weight-%: 1.2 to 2.5 C; 0.8 to 2.0 Si, which partly can be replaced by aluminium, which may exist in an amount of max 1.0%; 0.1 to 1.5 Mn; 0.5 to 1.5 Cr; 1.2 to 5.0 (V+Nb/2), however max 1.0 Nb; balance iron and impurities in normal amounts, and having a microstructure which contains 4 to 12 volume-% of MC-carbides. The steel article can be used for manufacturing of cold-work tools, particularly pilger rolls for cold rolling of tubes. The invention also relates to a method of manufacturing the article.

28 Claims, 3 Drawing Sheets

STEEL COLD WORK TOOL, ITS USE AND MANUFACTURING

TECHNICAL FIELD

The invention relates to a steel article, its use for the manufacturing of cold-work tools and a method for the manufacturing of the article.

BACKGROUND OF THE INVENTION

High demands are raised on materials for cold-work steels, particularly for certain applications, which demands cannot be satisfied satisfactorily with those materials which for the time being are commercially available. This is particular true in connection with applications where abrasive wear is a dominating problem, at the same time as the object shall have an adequate toughness. An application of that kind is for rolls for cold rolling of stainless steel and particularly rolls for the manufacturing of stainless tubes, an application for which the invention has specifically been developed. The invention, however, can be applied also for other types of cold-work steels, as for example for tools for cold-extrusion, powder-pressing, and deep drawing.

A steel grade which today is used for rolls for pilger rolling of stainless tubes is known under its trade name SR1855 and has the nominal composition 0.96 C, 1.50 Si, 0.80 Mn, 1.0 Cr balance iron and impurities in normal amounts. That steel provides an adequate toughness to products like pilger rolls for the manufacturing of stainless tubes. The steel, which is manufactured in a conventional way, however, has an unsatisfying wear resistance and also bad surfaces because of large carbides of $M_3C$-type. An other steel which has been tested for pilger rolls is the steel grade which is powder metallurgical manufactured and which is known under the registered trade mark VANADIS®4 and which has the nominal composition 1.5 C, 1.0 Si, 0.4 Mn, 8.0 Cr, 1.5 Mn, 4.0 V, balance iron and impurities in normal amounts. Also the standardised hot-work steel SS2242 has been used for pilger rolls. That steel has the nominal composition 0.39 C, 1.0 Si, 0.4 Mo, 5.2 Cr, 1.4 Mn, 0.9 V, balance iron and impurities in normal amounts. Further, the standardised high-speed steel M1 is used and also the commercial, powder metallurgical manufactured high-speed steel VANADIS®23, which has the nominal composition 1.28 C, 4.4 CR, 5.0 Mo, 6.4 W, 3.1 V, and normal amounts of Mn, Si and unavoidable impurities. The last mentioned steel has a very good wear resistance but does not provide an adequate toughness to the product. Besides, these steels are comparatively expensive because of their high content of alloying elements, and/or because of the powder metallurgical manufacturing.

BRIEF DISCLOSURE OF THE INVENTION

The object of the invention is to provide a material for cold-work rolls for pilger rolling of stainless tubes, but which also can be used for other cold-work applications, and which combine a very good wear resistance, particularly a very good resistance against abrasive wear, with an adequate toughness of the product. This can be achieved through the chemical composition of the steel which is a characteristic feature of the invention, in combination with a manufacturing technique, which neither is conventional (in order to avoid undesirably large carbides because of the slow cooling process in connection with conventional ingot production and/or continuous casting), or powder metallurgical, which provides too small carbides for the achievement of the desired wear resistance of the product.

The chemical composition of the steel of the invention is stated in the appending patent claims and will be commented more in detail in the following.

The structure of the steel of the article according to the invention, after hardening and in tempering substantially consists of tempered martensite, which contains 4 to 12 volume-% of carbides of MC-type, which are precipitated during the solidification process, at least about 80 volume-%, preferably at least 90 volume-%, of the carbides having a size which is larger than 1 $\mu$m but smaller than 20 $\mu$m.

In order to achieve the above mentioned carbide dispersion some techniques can be employed which are known per se. In the first place the so called spray forming technique is recommended, which is also known under the name the OSPREY-method, in connection with which a casting successively is established therein that a melt in the form of drops are sprayed against the growing end of the ingot which is continuously manufactured due to the fact that the drops solidify comparatively rapidly once they have hit the substrate, however not as fast as in connection with powder manufacturing and not as slow as in connection with conventional manufacturing of ingots or in connection with continuous casting. By employing this technique, the precipitated, above mentioned, MC-carbides more particularly will obtain sizes substantially within the lower part of the said size range of 1 to 20 $\mu$m, more specifically within the range 1 to 10 $\mu$m, and typically within the range 2 to 10 $\mu$m.

Another useful technique is ESR-remelting (Electro Slag Remelting), particularly for the manufacturing of products with larger dimensions, i.e. with diameters from Ø350 mm and up to 600 mm. By employing this technique the precipitated, above mentioned, MC-carbides more particularly will obtain sizes substantially within the upper part of the said size range of 1 to 20 $\mu$m, more specifically within the range 3 to 20 $\mu$m, and typically within the range 5 to 20 $\mu$m.

As far as the various alloying elements in the steel are concerned, the following applies.

Carbon shall exist in a sufficient amount in the steel in order, on one hand, together with vanadium and possibly existing niobium to form 4 to 12 volume-% of MC-carbides, where M substantially is vanadium, and on the other hand to exist in solid solution in the matrix of the steel in an amount of 0.8 to 1.1%, preferably 0.9 to 1.0%. Suitably, the content of carbon that is dissolved in the matrix of the steel is about 0.95%. The total amount of carbon in the steel, i.e. carbon that is dissolved in the matrix of the steel plus that carbon that is bound in carbides, shall be at least 1.2%, preferably at least 1.3%, while the maximum content of carbon may amount to 2.5%, preferably max. 2.3%.

According to a first preferred embodiment of the invention, the steel contains 1.7 to 2.0 carbon, preferably 1.75 to 1.9 carbon, nominally about 1.8 carbon, in combination with nominally about 3.6 vanadium in order to provide a total content of MC-carbides amounting to 6 to 12, preferably 7 to 10 volume-% of MC-carbides, in which vanadium partly can be replaced by the double amount of niobium.

According to a second preferred embodiment, the steel contains 1.5 to 1.8, preferably 1.55 to 1.7, and suitably nominally about 1.6 carbon, in combination with nominally about 2.3 vanadium, which partly possibly can be replaced by the double amount of niobium in order to provide 4 to 8, preferably 4 to 6 volume-% of MC-carbides in the steel.

Silicon, which partly can be replaced by aluminium, shall, together with possibly existing aluminium, exist in a total amount of 0.8 to 2%, preferably in an amount of 1.2 to 1.8%, most suitably in an amount of 1.3 to 1.7% or as a nominal content of about 1.5% in order to increase the carbon activity in the steel and hence contribute to the achievement of an adequate hardness of the steel without creating brittleness problems because of dissolution hardening at too high contents of silicon. The aluminium content however, must not exceed 1.0%. Preferably, the steel does not contain more than max 0.1% Al.

Manganese and chromium shall exist in the steel in a sufficient amount in order to give the steel an adequate hardenability. Manganese also has the function to bind those residual amounts of sulphur, which can exist in low contents in the steel by forming manganese sulphide. Manganese therefore shall exist in an amount of 0.1 to 1.5%, preferably in an amount of at least 0.2%. A most suitable content lies in the range 0.4 to 1.2%, most conveniently in the range 0.7 to 1.1%. The nominal content of manganese is about 0.8%.

Chromium shall exist in the steel in order, together with manganese, to give the steel a hardenability, which is adapted to its intended use. Hardenability in this connection means the ability of the hardening to penetrate more or less deep in the object that is hardened. The hardenability shall be sufficient for the object to be hardened down to a certain depth from the surface, so that in the surface region a hardness is achieved after hardening and tempering which amounts to 58 to 62 HRC, while in the centre of the object, or at a depth of 30 mm from the surface or deeper, there is obtained a hardness which does not exceed 40 HRC after hardening and tempering. For the achievement of this, the chromium content shall amount to 0.5 to 1.5%, preferably 0.7 to 1.3% and most suitably to 0.9 to 1.15%. The nominal chromium composition is about 1.0%.

Vanadium shall exist in the steel in an amount of at least 1.2% and max 5.0%. Preferably, the content of vanadium shall lie in the range 1.8 to 4.2% in order to form MC-carbides together with carbon. In principle, vanadium can be replaced by niobium. But for this twice as much niobium is needed as compared with vanadium, which is a drawback. Besides, niobium will cause the carbides to adopt a more edged shape and they will also be larger than pure vanadium carbides, which can initiate fractures or chippings and consequently reduce the toughness of the material. Therefore niobium must not exist in an amount of more than max 1.0%, preferably max 0.5%. Most advantageously the steel should not contain any intentionally added niobium, which in the most preferred embodiment of the steel therefore should not be tolerated more as an impurity in the form of residual elements from the raw materials used for the manufacturing of the steel.

According to said first preferred embodiment, the content of MC-carbides in the material shall amount to 6 to 12 volume-%. The content of vanadium in this case should amount to at least 3.2% and to max 4.2%, preferably be 3.4 to 4.0%, suitably max 3.8%. The nominal content of vanadium according to this first embodiment is 3.6% vanadium.

According to the above-mentioned second, preferably chosen embodiment, the content of vanadium should be at least 1.8% and max 3.0%, and suitably lie in the range 1.9 to 2.5%. The nominal content of vanadium in this case is about 2.3%.

The steel need not, and should not, contain any more alloying elements in significant amounts in addition to the above-mentioned alloying elements. Some elements are definitely undesired, because they have an undesired influence on the features of the steel. This e.g. is a case for molybdenum and tungsten, which form undesired carbides. Molybdenum also strongly increases the hardenability of the steel, which is against one of the purposes of the invention, namely to provide a tough core in the product. Molybdenum and tungsten therefore preferably should not exist as intentionally added elements, which can be tolerated in an amount of max 0.3 and max 0.6, respectively, but should preferably not exist more than as unavoidable impurities in an amount of max 0.05% of each of them.

Phosphorous should be kept as low as possible in order not to impair the toughness of the steel. Also sulphurous is an undesired element, but its negative impact on the toughness can substantially be neutralised by means of manganese, which forms essentially harmless manganese sulphides. Sulphur therefore can be tolerated in a maximum amount of 0.05%, preferably max 0.02%. Nickel is another undesired element because of its hardenability effect and should therefore not exist in an amount higher than 0.3%, preferably not more as an unavoidable impurity. The total amount of nickel, molybdenum, and copper should not exceed 0.5%, preferably not exceed 0.25%. Nitrogen exists as an unavoidable impurity in the steel but does not exist as an intentionally added element.

Cobalt can be tolerated in an amount of max 1.0% as an indifferent element. Cobalt, however, is an expensive element and should therefore not exist more than as an unavoidable impurity from the used raw materials.

In the manufacturing of the steel article according to the invention, first a melt a prepared in a conventional way by melting necessary raw materials, adjusting the alloy, desoxidation, and desulphurisation. Then ingots can be made from this melt by employing some conceivable techniques, depending on the desired carbide sizes in the finished, hardened and tempered steel, which in its turn depends on the intended use of the steel. If comparatively small carbides are desired, which means that at least 80 volume-% shall have sizes within the range 1 to 10 $\mu$m, preferably within the range 2 to 10 $\mu$m, suitably the spray forming technique is employed, which technique is also known by its trade name OSPREY. More information about this technique can be found in an article having the title: "The production of advanced materials by means of the OSPREY process" by A. G. Leatham et al in Modern Developments in Powder Metallurgy, Vol. 18–21, 1988, issued by Metal Powder Industries Federation, Princeton, N.J.

If instead somewhat coarser carbides are desired, which means that at least 80 volume-% shall have sizes within the range 3 to 20 $\mu$m, preferably 5 to 20 $\mu$m, a number of ingots can be cast from the melt, with sizes suitable for electrodes for ESR-remelting (Electro Slag Remelting), the ingots thereafter being ESR-remelted in order to form ingots for further processing. The produced ingots, whether they are produced by spray forming or by ESR-remelting, then are forged and/or rolled to desired dimensions for the achievement of the article according to the invention At the manufacturing in laboratory scale, which shall be described in the following, however, none of the above mentioned techniques have been employed. Nor has the whole process sequence been applied for the preparation of the metal melt, which briefly is described above and which is employed for full-scale production. Instead 50 kg laboratory heats were manufactured by melting measured quantities of alloying elements in order, as close as is possible by means of that simple technique, to obtain nominal compositions of the experimental materials. Thereafter the melt was cast in uninsulated moulds, in which the melt was allowed to cool, so that ingots were obtained having octagonal, 150 mm cross-section. The ingots then were forged to size Ø60 mm. Microscope studies of the thus obtained materials, which had a chemical composition of the invention, showed that the desired size distribution of MC-carbides of the invention, see above, was achieved. This indicates that the manufacturing technique, which provides ingots having the said dimension, makes it possible to precipitate MC-carbides having the desired size and quantity during the solidification process, while larger undesired carbides are not formed. This also can be said to be a measure of the solidification rate, which is desirable for the achievement of the carbide structure of the invention. However, this does not mean that the ingots according to the invention shall be manufactured in these dimensions at a commercial production. At the commercial production of ingots with larger dimensions, such as according to the OSPRAY technique and/or according to the ESR-technique, the cooling is intensified, at least this being true as far as the OSPRAY-technique is concerned, because of the nature of the technique, so that the end result, as far as the carbide sizes are concerned, can be that which is achieved at said laboratory manufacturing of smaller ingots.

Further features and aspects of the invention will be apparent from the patent claims and from the following, detailed description of the invention and from performed experiments.

BRIEF DESCRIPTION OF DRAWINGS

In the following, the invention will be explained more in detail and performed experiments shall be described, reference being made to the accompanying drawings, in which.

DETAILED DESCRIPTION AND PERFORMED EXPERIMNTS

Figure 1:
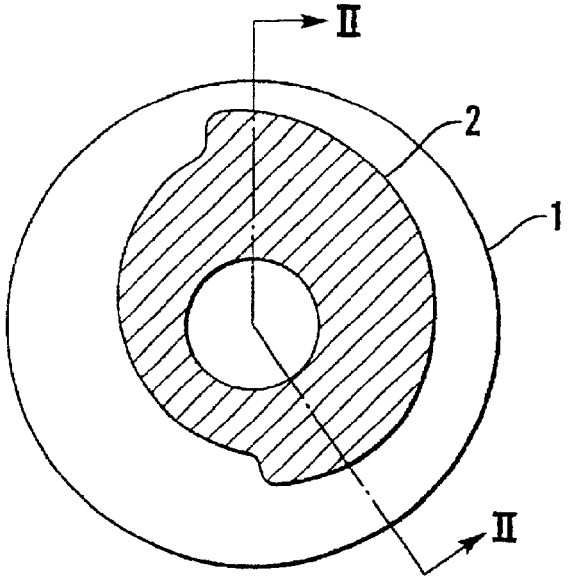
FIG. 1 shows the principle design of a pilger roll for cold rolling of stainless tubes.
Figure 2:
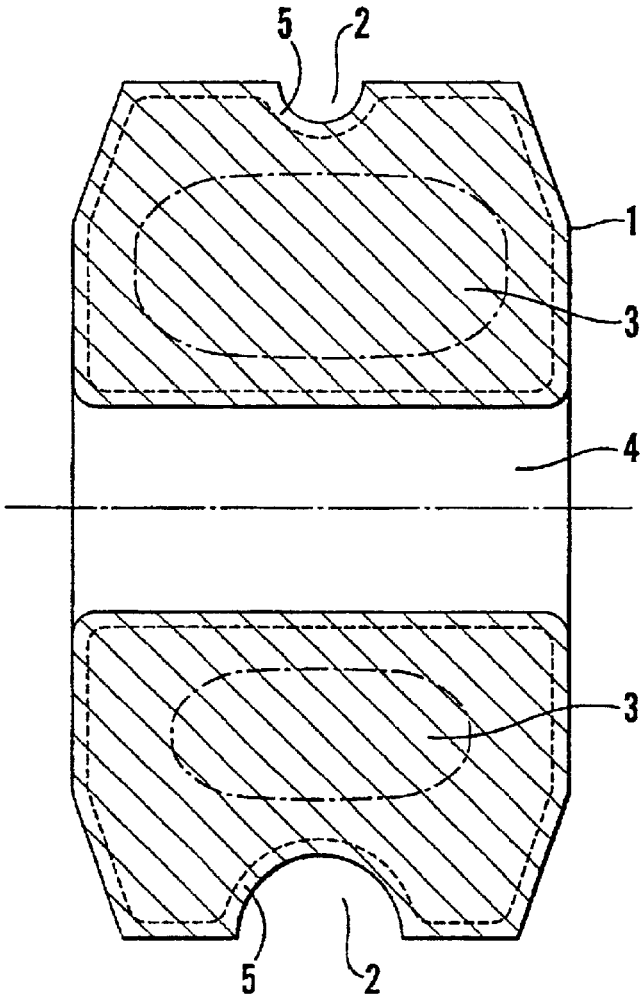
FIG. 2 shows the pilger roll in cross-section along the line II—II in FIG. 1.

When cold rolling tubes, such as tubes of stainless steel, according to the pilger rolling process, two opposite rolling mill rolls are used, in this text denominated rolls 1, of the type which is shown in FIG. 1 and FIG. 2. The two rolls have a tapered groove 2 covering approximately half the circumference of the rolls. The groove starts with a dimension, which is equal to that of the hot rolled tube, which is the starting material for the pilger rolling, and tapers towards the final size. A central boring for a not shown shaft is designated 4.

During the rolling, the rolls are subjected to a rapid movement fore-and backwards. The rolling is performed during the forward movement. At pilger rolling very big reductions are possible, up to 90%. For stainless steel tubes 50 to 70% are common values. Thus, one pass at pilger rolling is equivalent to 3 to 5 passes at cold drawing. The velocity is between 40 to 100 strokes/min and the tube feeding is between 4 and 15 mm/stroke. It should be understood that the stresses on the pilger rolls, which are used at the above-described cold-working operation, are very high. Therefore, particularly the wear resistance in the groove 2, which is the active working part for the forming of a tube has to be very good, at the same time as the toughness in a surface layer 5 has to be sufficient in order to prevent chipping, and the toughness of the entire tool has to be adequate in order to prevent total failure because of brittle fracture. Thus the centre portion 3 of the tool, which has been indicated by dotted lines in FIG. 2, between the groove 2 and the centre hole 4, should have a very good toughness.

The centre part 3 the tool material thus shall have a low hardness, which gives sufficient toughness to the whole tool 1, while the roll 1 in the region 5 of the groove 2 down to a certain depth measured from the surface shall have a hardness of 58 to 62 HRC and a very high wear resistance, and a sufficient toughness in the core of the article in order to prevent complete failure of the article and in the surface region to prevent chippings. The same principle is applicable also for other types of cold-work tools than pilger rolls. The said hardening depth, however, may vary depending on the intended use of the steel for different types of tools, and the dimensions and shapes of the tools. For certain applications, a hardening depth of at least about 10 $\mu$m measured from the surface may be desirable and suitable, while in other cases it is sufficient and/or desirable that the tool has a hardness of 58 to 62 HRC only down to a depth of about 3 $\mu$m measured from the surface.

Experiments Based on Production at a Laboratory Scale

A first series of experiments based on production at a laboratory scale aimed at investigating if a material of the invention can satisfy the said requirements of the material in said region 5 in a conceived pilger roll.

In Table 1, the compositions of steels Nos. 1 to 3 correspond to the nominal composition of the experimental alloys in this first series of experiments. Steels Nos. 4 to 6 are experimental alloys, the values stated in Table 1 being the analysed compositions of these steels. The values of steels Nos. 7 and 8 are the nominal compositions of a couple of steels according to the invention having preferably chosen compositions, based on the result from the first series of experiments. Besides the elements mentioned in Table 1, the steels also contained minor amounts of other impurities than those which are stated. Thus the oxygen content of the steels Nos. 4 to 6 amounted to 48, 43, and 41 ppm, respectively. In the table, steels No. 1 and No. 4 are reference material of type SR1855.

TABLE 1

| Steel No. | C | Si | Mn | P | S | Cr | Ni | Mo | V | N | Balance |
|---|---|---|---|---|---|---|---|---|---|---|---|
| | Chemical composition, weight-% | | | | | | | | | | |
| 1 | 0.96 | 1.50 | 0.80 | Max 0.025 | Max 0.020 | 1.0 | Max 0.10 | Max 0.07 | Max 0.03 | Max 0.03 | Fe |
| 2 | 1.50 | 1.50 | 0.80 | Max 0.025 | Max 0.020 | 1.0 | Max 0.10 | Max 0.07 | 2.0 | Max 0.03 | " |
| 3 | 2.00 | 1.50 | 0.80 | Max 0.025 | Max 0.020 | 1.0 | Max 0.10 | Max 0.07 | 4.0 | Max 0.03 | " |
| 4 | 0.95 | 1.28 | 0.84 | 0.007 | 0.005 | 1.23 | 0.14 | 0.03 | 0.09 | 0.011 | " |
| 5 | 1.43 | 1.28 | 0.88 | 0.008 | 0.006 | 1.21 | 0.15 | 0.01 | 1.86 | 0.016 | " |
| 6 | 1.91 | 1.17 | 0.98 | 0.011 | 0.008 | 1.23 | 0.16 | 0.01 | 4.07 | 0.030 | " |
| 7 | 1.8 | 1.50 | 0.80 | Max 0.025 | Max 0.020 | 1.0 | Max 0.10 | Max 0.07 | 3.6 | Max 0.03 | " |
| 8 | 1.6 | 1.50 | 0.80 | Max 0.025 | Max 0.020 | 1.0 | Max 0.10 | Max 0.07 | 2.3 | Max 0.03 | " |

50 kg heats were made of the experimental alloys, which were cast in moulds to form ingots, which were forged to Ø60 mm.

The following material tests were performed:

Hardness (HB) after soft annealing.

Microstructure in soft annealed condition and after heat treatment 870° C./30 min/oil+300° C./2×2 h, in the surface and centre of Ø60 mm.

Hardness after tempering 300° C./2×2 h for $T_A$=870° C./min/oil.

Wear testing against $SiO_2$-paper. $T_A$=870° C./min/oil+300° C./2×2 h.

Impact testing with unnotched test specimens at 20° C., LT2. $T_A$=870° C./min/oil+300° C./2×2 h.

Hardness After Soft Annealing

At the working of cold-work tools, such as for example pilger rolls, by means of cutting tools, it is desirable that the hardness in the soft annealed condition is not too high. The soft annealed hardness of the steels 5 and 6 were measured to 249 HB and 269 BB, respectively, which is satisfactory. The reference material, steel No. 4, had a soft annealed hardness of 241 HB.

Microstructure

Figure 3:
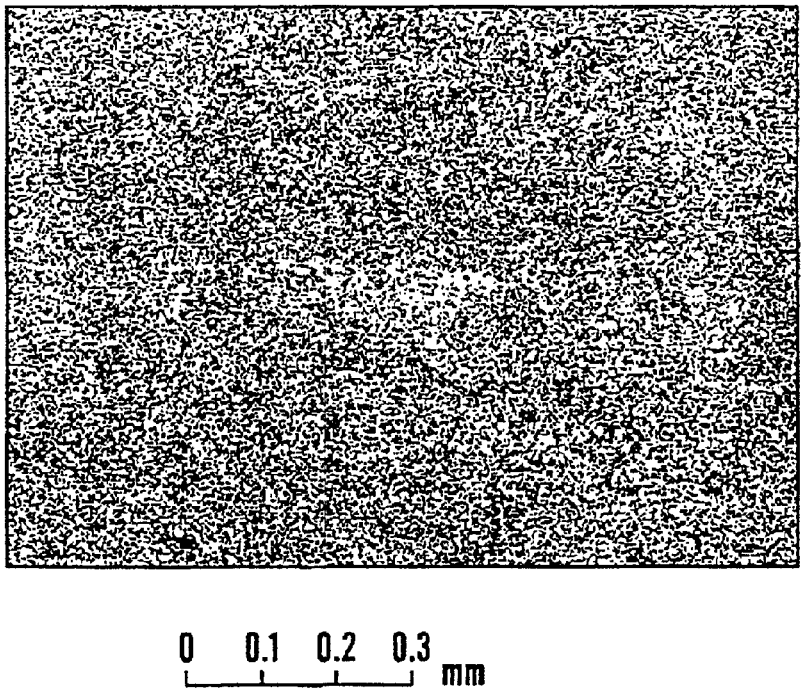
FIG. 3. shows the microstructure of an experimental material.

The microstructure in the soft annealed condition and after heat treatment at 870° C./30 min/oil+300° C./2×2 h at the surface and in the centre of the rod which had the size Ø60 mm was examined. The amount of MC-carbides with sizes within the size range which is characteristic of the invention, see above and the appending patent claims, increased with the increased vanadium content, and it was stated that also the vanadium carbides were evenly dispersed in the material. In FIG. 3 the microstructure in the soft annealed condition of steel No. 6 is shown.

Hardness After Hardening and Tempering

Figure 4:
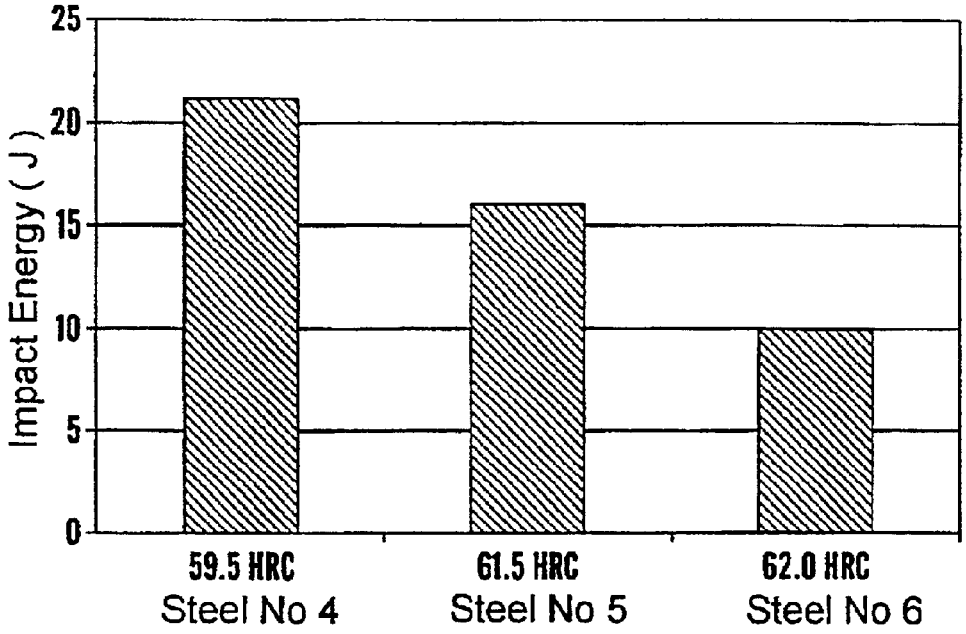
FIG. 4 shows the impact strength and the hardness of examined materials.

According to the listed requirements of the invention it is desirable that the surface hardness of the finished tool is 58 to 62 HRC, most preferably at least 60 HRC. In FIG. 4 the hardness of the test materials after austenitising at $T_A$=870° C./30 min/oil, quenching in oil and tempering at 300° C./2×2 h is shown.

Toughness

The results of tensile testing performed at room temperature with unnotched test specimens is also shown in FIG. 4 for steels Nos. 4, 5 and 6. The toughness is reduced with increased vanadium content but is judged still to be sufficient to prevent chipping in the surface layer of the tool.

Abrasive Wear

Figure 5:
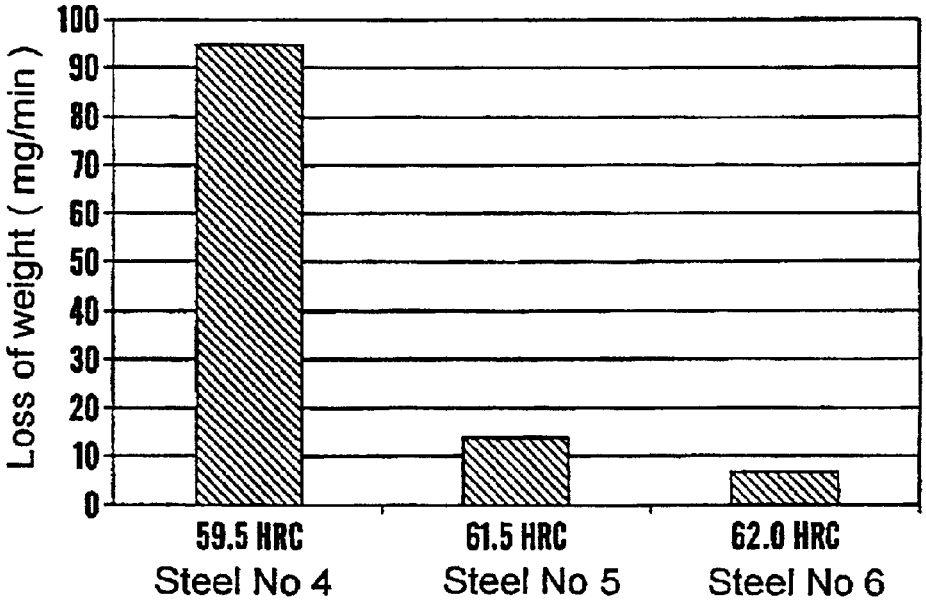
FIG. 5 is a bar chart showing the wear of some examined experimental materials.

The resistance to abrasive wear is a critical material feature of particularly pilger rolls but also of cold-work tools for several other applications. The wear resistance was examined via pin-to-disk-test with $SiO_2$ as an abrasive agent. The chart in FIG. 5 shows that the wear resistance of steels No. 5, and particularly steel No. 6 was strongly much better than of the reference material steel No. 4. The test materials had been hardened from 870° C./30 min, quenched in oil and tempered at 300° C./2×2 h.

The material tests, which were performed with specimens made of the three laboratory heats, showed that a high content of MC-carbides, where M substantially is vanadium, is necessary for the achievement of a desired abrasive, but also adhesive wear resistance. Particularly steel No. 6 satisfies that requirement. That steel also satisfies the requirement as far as desired surface hardness is concerned.

Experiments Based on Full Scale Production

By the employment of conventional steel manufacturing technique there were manufactured full scale beats of steels having the chemical compositions according to Table 2.

TABLE 2

| Steel No. | C | Si | Mn | P | S | Cr | Ni | Mo | V | N | Balance |
|---|---|---|---|---|---|---|---|---|---|---|---|
| | Chemical composition, weight-% | | | | | | | | | | |
| 9 | 1.51 | 1.48 | 0.85 | 0.029 | 0.026 | 0.96 | 0.1 | 0.21 | 2.23 | 0.049 | Fe |
| 10 | 1.63 | 1.26 | 0.83 | 0.016 | 0.0007 | 1.02 | — | 0.05 | 2.38 | 0.011 | Fe |

Besides the alloying elements and the impurities stated in Table 2, the steels only contained iron and other impurities than those mentioned in the table in amounts which are normal in conventional steel manufacturing practice.

Steel No. 9, however, unintentionally contained a higher content of molybdenum than what is desirable, but below the level which maximally can be tolerated within a wide tolerance range.

EXAMPLE 1

From steel No. 9 there was cast an ingot with size Ø500 mm by the spray forming technique; briefly in the following way. Droplets were formed by gas atomisation of a stream of molten steel. The melt droplets were initially sprayed against a rotating disc, on which they quickly solidified by rapid cooling; cooling rate about $10^2$ to $10^{3°}$ C./s. An ingot was successively established on the plate, size Ø500 mm, and the spraying of droplets was continued towards the growing ingot in a mode which is known per se until the ingot had achieved the desired length. The obtained ingot was then allowed to cool freely in air, was then heated to about 100 to 1200° C., and was forged to the shape of bars having a final dimension of Ø220 mm Samples were taken from the surface and from the centre of one of the manufactured bars. Soft annealed samples had a hardness of about 260 HB (Brinell hardness). The samples were hardened by heating to 870° C./30 min and then quenched in oil, whereafter the samples were tempered at 300° C./2+2 h. The hardness, impact strength of unnotched samples at 20° C., wear resistance against $SiO_2$-paper and microstructure of the hardened and tempered samples were examined. The following values were achieved:

Hardness: about 61 to 62 HRC, mean value 61.5 HRC

Impact strength (impact energy): 12 J (surface sample)

13.5 J (centre sample

Wear resistance (loss of weight) 8.9 mg/min (source sample)

8.8 mg/min (centre sample)

Microstructure (carbide sizes): >80 volume-% of the carbides in the surface samples had a size of 1 to 5 μm, mean value about 2 to 3 μm >80 volume-% of the carbides in centre samples had a size of 2 to 10 μm, mean value about 6 μm

EXAMPLE 2

From steel No. 10 there were manufactured electrodes, which were Electro Slag Remelted to form an ingot with the dimension □ 400 mm. The ingot was forged to the shape of bars with the dimension Ø220 mm, from which samples were taken, which were heat treated and tested in the same way as in Example 1. The following values were obtained:

Soft Annealed Samples

Hardness 221 HB (surface sample)

234 HB (centre sample)

Hardened and Tempered Samples (Mean Values)

Hardness about 59 HRC

Impact strength (impact energy) about 15 j

Wear resistance (weight loss) about 11.5 mg/min

Microstructure (carbide size)

>80 volume % of the carbides had sizes in the range 5 to 20 μm occasional carbides had sizes up to max 80 μm×10 μm

What is claimed is:

What is claimed is:

1. Steel article consisting of an alloy having a chemical composition which contains in weight-%

1.2 to 2.5 C, 0.8 to 2.0 Si, which partly can be replaced by aluminium, which may exist in an amount of max 1.0%, 0.1 to 1.5 Mn, 0.5 to 1.5 Cr, 1.2 to 5.0 (V+Nb/2), however max 1.0 Nb, max 0.3 Mo, max 0.6 W, balance iron and impurities in normal amounts, and having a microstructure which contains 4 to 12 volume-% of MC-carbides.

2. Article according to claim 1, wherein at least about 80 volume-% of the MC-carbides has a size between 1 μm and 20 μm in the hardened and tempered condition of the steel.

3. Article according to claim 2, wherein at least about 80 volume-% of the MC-carbides has a size in the dimension range 1 to 10 μm in the hardened and tempered condition of the steel.

4. Article according to claim 2, wherein at least about 80 volume-% of the MC-carbides has a size in the dimension range 3 to 20 μm in the hardened and tempered condition of the steel.

5. Article according to claim 1, wherein the alloy contains at least 1.3 and max 2.3 C.

6. Article according to claim 5, wherein the alloy contains 1.8 to 4.2 V.

7. Article according to claim 6, wherein the alloy contains 1.7 to 2.0 C and 3.2 to max 4.2 V, and that the quantity of MC-carbides in the material amounts to 6 to 12 volume-%.

8. Article according to claim 6, wherein the alloy contains 1.5 to 1.8C and 1.8-max 3.0, V, and that the quantity of MC-carbides in the material amounts to 4 to 8 volume-%.

9. Article according to claim 1, wherein the alloy contains 1.2 to 1.8 Si, max 0.5 Al.

10. Article according to claim 1, wherein the alloy contains max 0.5% Nb.

11. Article according to claim 1, wherein the alloy contains at least 0.2 Mn.

12. Article according to claim 1, wherein the alloy contains 0.7 to 1.3 Cr.

13. Cold-work tool, consisting of a tool made of a steel article according to claim 1 and wherein after hardening and tempering, the tool has a hardness of 58 to 62 HRC in a surface layer (5), while the hardness in the core of the tool is max 40 HRC.

14. Cold-work tool according to claim 13, wherein the hardness in the surface layer is at least about 60 HRC.

15. A method of manufacturing a steel article, comprising:

preparing a metal melt consisting of an alloy having a chemical composition according to claim 1, continuously making an ingot of the melt, the melt successively being supplied to the ingot which is caused to grow successively, cooling the successively supplied melt to solidify with a velocity corresponding to the solidification velocity which is achieved at any of those continuous processes which include spray forming and ESR-remelting, wherein, during the solidification process, vanadium combines with carbon to form MC-carbides of which at least about 80 volume-%, has a size between 1 and 20 μm.

16. Article according to claim 1, wherein at least about 90 volume-% of the MC-carbides has a size which is larger than 1 μm but smaller than 20 μm in the hardened and tempered condition of the steel.

17. Article according to claim 2, wherein at least about 90 volume-% of the MC-carbides has a size in the dimension range 1 to 10 μm in the hardened and tempered condition of the steel.

18. Article according to claim 17, wherein the dimension range is 2 to 10 μm.

19. Article according to claim 2, wherein at least about 90 volume-% of the MC-carbides has a size in the dimension range 3 to 20 $\mu$m, in the hardened and tempered condition of the steel.

20. Article according to claim 19, wherein the dimension range is 5 to 20 $\mu$m.

21. Article according to claim 6, wherein the alloy contains 1.75 to 1.9 C, and 3.4 to 4.0 V and the quantity of MC-carbides in the material amounts to 7 to 10 volume-%.

22. Article according to claim 21, wherein the alloy contains max 3.8 V.

23. Article according to claim 6, wherein the alloy contains 1.55 to 1.7 C, and 1.9 to 2.5 V, and the quantity of MC-carbides in the material amounts to 4 to 6 volume-%.

24. Article according to claim 1, wherein the alloy contains 1.3 to 1.7 Si, max 0.1 A1.

25. Article according to claim 1, wherein the alloy contains at least 0.4 to 1.2 Mn.

26. Article according to claim 25, wherein the alloy contains 0.7 to 1.1 Mn.

27. Article according to claim 1, wherein the alloy contains 0.9 to 1.15 Cr.

28. Method according to claim 15, wherein at least 90 volume % has a size between 1 and 20 $\mu$m.

* * * * *